US006040004A

United States Patent [19]

Matsumoto et al.

[11] Patent Number: 6,040,004

[45] Date of Patent: Mar. 21, 2000

[54] METHOD AND APPARATUS FOR FABRICATING A PARTICLE-COATED SUBSTRATE, AND SUCH SUBSTRATE

[75] Inventors: Kenji Matsumoto, Kawasaki; Kazuo Suzuki; Muneo Haga, both of Sagamihara, all of Japan

[73] Assignee: 3M Innovative Properties Company, St. Paul, Minn.

[21] Appl. No.: 08/875,713

[22] PCT Filed: Mar. 8, 1996

[86] PCT No.: PCT/US96/03091

§ 371 Date: Aug. 1, 1997

§ 102(e) Date: Aug. 1, 1997

[87] PCT Pub. No.: WO96/28256

PCT Pub. Date: Sep. 19, 1996

[30] Foreign Application Priority Data

Mar. 9, 1995 [JP] Japan ..... 7-049603

[51] Int. Cl.[7] ..... B05D 7/00

[52] U.S. Cl. ..... 427/185; 427/421; 427/427; 118/600; 118/612; 118/629; 118/308

[58] Field of Search ..... 366/101; 406/194; 222/195, 226, 183, 328, 399; 239/142, 143, 372; 118/600, 612, 629, 308; 427/421, 427, 289, 180, 185; 451/99

[56] References Cited

U.S. PATENT DOCUMENTS 3,389,507 6/1968 Flaig ..... 451/99
3,709,434 1/1973 Gebhardt et al. ..... 239/8
4,095,557 6/1978 Croop et al. ..... 118/324

FOREIGN PATENT DOCUMENTS 2103959 3/1983 United Kingdom ..... B05B 7/20

OTHER PUBLICATIONS

Patent Abstracts of Japan, vol. 005, No. 022 (M–054), Feb. 10, 1981 & JP,A,55 149000 Nov. 19, 1980.

Patent Abstracts of Japan, vol. 007, No. 223 (M–247) Oct. 4, 1983 & JP,A,58 117400 Jul. 12, 1983.

*Primary Examiner*—Laura Edwards
*Attorney, Agent, or Firm*—James J. Trussell

[57] ABSTRACT

A particle-coated substrate (in particular, an abrasive material formed by coating a substrate with abrasive particles) in which a substrate is coated uniformly and in a thin layer with cohesive fine particles, a particle ejector for fabricating the coated substrate, a coated substrate fabricating apparatus comprising the ejector, a particle-coated substrate fabricating method (in particular, a method of fabricating an abrasive material in which a substrate is coated with abrasive particles), and an abrasive sheet. Agitation gas is fed through the porous wall of a particle storage container in the ejector, and an ejection gas is fed from an ejector nozzle through the container to deliver the fluidized particles and ejection gas through a discharge tube generally coaxial with the ejection gas nozzle. The particle ejector is capable of attaining a uniform particle size distribution without causing the particles to undergo blocking, agglomeration, or bridging.

3 Claims, 7 Drawing Sheets

METHOD AND APPARATUS FOR FABRICATING A PARTICLE-COATED SUBSTRATE, AND SUCH SUBSTRATE

TECHNICAL FIELD

The present invention relates to a particle-coated substrate (in particular, an abrasive material formed by coating a substrate with abrasive particles) in which a substrate is coated uniformly and in a thin layer with cohesive fine particles, a particle ejector for fabricating the coated substrate, a coated substrate fabricating apparatus comprising the ejector, a particle-coated substrate fabricating method (in particular, a method of fabricating an abrasive material in which a substrate is coated with abrasive particles), and an abrasive sheet.

BACKGROUND OF THE INVENTION

The known conventional particle ejecting pump in a coating device in which particles are fed out along with gas from a coating gun nozzle is, for example, constructed as shown in FIG. 12. More specifically, a porous plate 2 on which particles to be coated are placed is provided at a lower portion of a particle feed tank 7. The porous plate 2 is provided with a straight particle feed tube 8, one end of which is opened to the porous plate 2 and the other end of which is connected to an ejector 9. In the pump of such a construction, particles 1 are fed to upside of the porous plate 2, and fluidizing air 6 fed to the downside of the particle feed tank 7 passes through the porous plate 2 and agitates the particles 1 on the porous plate 2. Further, the particles 1 are fed to the ejector 9 via the particle feed tube 8 by an internal pressure Pa in the particle feed tank 7. Other similar examples are disclosed in Japanese Patent Laid-Open Publications No. 6-286872 and 6-304502.

Such a conventional particle-coated substrate fabricating apparatus has had the following problems. Even if a proper particle size distribution of the particles 1 is obtained by agitating the particles 1 so that it is brought into a fluidized state on the porous plate 2 (hereinafter, the term "agitation" means an agitation for imparting a fluidized state), the particles 1 would be subject to blocking, agglomeration or bridging again inside the particle feed tube 8 and in the container of the ejector 9 so that the particle size of the particle would be coarsened. The above "bridging" means that supplying particles are adhered in a certain range of size. The above "blocking" means that the bridging particles are adhered to each other and agglomerate. As a result, even if the particles 1 undergo shear due to a gas stream 5 fed to the ejector 9, the particles 1 would agglomerate and thereby have a coarsened particle size and a varied particle size distribution. Consequently, the conventional coating device has had difficulty in ejecting fine particles having a particle size distribution of 5 $\mu$m or less without agglomeration. Furthermore, even if the particles 1 have a relatively large particle size, its particle size distribution would vary with time, encountering difficulty in controlling the particle size.

The object of the present invention is, therefore, to remedy the above-described disadvantages and to provide a particle ejector capable of attaining a uniform particle size distribution, a particle-coated substrate fabricating apparatus comprising the ejector, a particle-coated substrate fabricating method, a particle-coated substrate and a coated abrasive sheet having a uniform particle size distribution. While the present invention advantageously overcomes the problems described above with spraying particles of 5 $\mu$m or less, the present invention is not thereby limited and may of course also be advantageously used with particles larger than 5 $\mu$m.

SUMMARY OF THE INVENTION

In order to achieve the above-described object, according to the present invention, there is provided an ejector for ejecting particles to be coated onto a substrate, comprising:

a storage container made of a porous material, the container including an interior adapted for storing particles in the container and an outer surface;

an ejection gas nozzle extending from outside the container to the interior and provided at a bottom portion of the storage container, in a portion thereof where the particles are stored, adapted for feeding to the interior of the storage container an ejection gas to be ejected to outside of the storage container;

a discharge tube arranged generally coaxially of the ejection gas nozzle at the bottom portion of the storage container and extending from the interior of the container to outside the container, and adapted for sending the ejection gas and the particles from the interior to outside of the storage container; and an agitation gas inlet in fluid communication with the outer surface of the porous storage container adapted for feeding an agitation gas from the outside of the storage container through the porous container to the interior of the storage container to perform agitation for imparting a fluidized state to the particles present at least at the bottom portion of the storage container interior where the ejection gas nozzle and the discharge tube are disposed.

With the above construction, the agitation gas, passing through the porous material to the inside of the storage container, is fed to at least the bottom portion of the storage container where the ejection gas nozzle and the discharge tube are disposed, whereby the particles are agitated within the storage container. Accordingly, the storage container acts so that the particles to be stored will not undergo blocking, agglomeration or bridging, and that a uniform particle size of the particles will be obtained.

In a variation of the above embodiment, there is further provided an outer container forming a gas-pressure buffer portion defined by a clearance between the outer container and the outer surface of at least the bottom portion of the storage container where the ejection gas nozzle and the discharge tube are disposed, wherein the agitation gas inlet is in fluid communication with the buffer portion. In a preferred embodiment, the gas-pressure buffer portion is formed so as to surround the storage container.

Also, according to the present invention, there is provided an apparatus including an ejector as described above for fabricating a particle-coated substrate, the apparatus comprising:

an ejector as described above;

a particle feeder for providing particles to the interior of the ejector storage container; and a coating device arranged in fluid communication with the discharge tube of the ejector for coating a substrate with the particles sent out from the ejector by means of the ejection gas.

With the above construction, in the ejector which is fed with particles from the particle feeder, the agitation gas passes through the inside of the storage container so as to be fed to the particles stored at least at the bottom portion of the storage container where the ejection gas nozzle and the discharge tube are disposed. As a result, the particles are agitated in the storage container. Accordingly, the ejector acts so that the particles will not undergo blocking, agglomeration or bridging and that a uniform particle size is obtained.

Also, according to the present invention, there is provided a method for fabricating a particle-coated substrate, comprising the steps of:

(a) feeding particles to a storage container of an ejector, the ejector comprising: a storage container made of a porous material, the container including an interior adapted for storing particles in the container and an outer surface;

(b) agitating the particles with an agitation gas provided through an agitation gas inlet in fluid communication with the outer surface of the porous container, through the porous container to the interior of the storage container to perform agitation for imparting a fluidized state on the particles present at least at the bottom portion of the storage container;

(c) ejecting the fluidized particles from the interior of the container by providing an ejection gas through an ejection gas nozzle extending from outside the container to the interior and provided at a bottom portion of the container where the particles are fluidized, the ejection gas and particles exiting the storage container through a discharge tube arranged generally coaxially of the ejection gas nozzle; and (d) coating a substrate with a coating device with the particles sent out from the discharge tube by means of the ejection gas.

In the particle agitating step, the agitation gas is fed to the particles stored at least at the bottom portion of the storage container where the ejection gas nozzle and the discharge tube are disposed, via the inner wall of the storage container provided to the ejector. As a result, the particles in the storage container are agitated so as not to undergo blocking, agglomeration or bridging, and a uniform particle size distribution can be obtained.

Also, according to the present invention, there is provided a coated substrate fabricated by using the above-described fabricating apparatus or fabricated by the above-described fabricating method.

In particular, the coated substrate is characterized by being coated with 5 $\mu$m or less abrasive particles by a particle spraying process.

The agitation gas is fed to the particles stored at least at the bottom portion of the storage container where the ejection gas nozzle and the discharge tube are disposed, via the inner wall of the storage container provided to the ejector. As a result, the particles in the storage container are agitated so as not to undergo blocking, agglomeration, or bridging, and a uniform particle size distribution can be obtained. Accordingly, a uniform particle size distribution can be obtained on the particles ejected from the ejector and coated onto the substrate.

DETAILED DESCRIPTION OF THE INVENTION

A particle-coated substrate, a particle ejector for fabricating the coated substrate, a coated substrate fabricating apparatus comprising the ejector, a particle-coated substrate fabricating method, and an abrasive sheet, which are embodiments of the present invention, are described hereinbelow with reference to the accompanying drawings. It is noted that the coated substrate is fabricated by the fabricating apparatus comprising the aforementioned particle ejector and fabricated by the coated substrate fabricating method.

Figure 1:
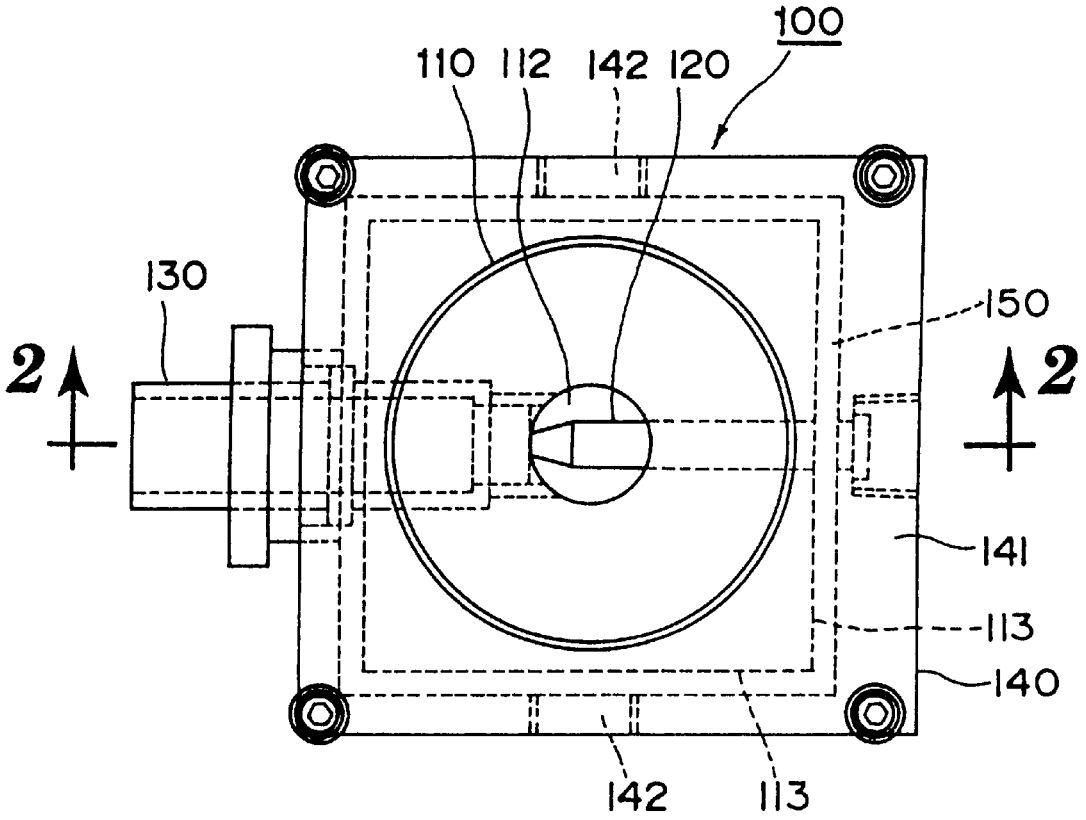
FIG. 1 is a plan view of a first embodiment of an ejector according to the present invention.
Figure 2:
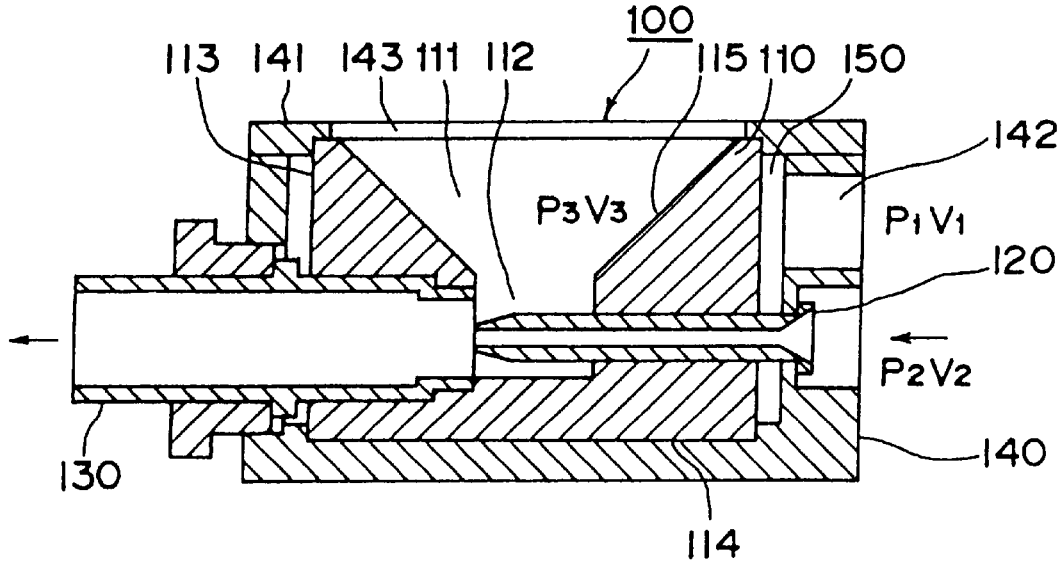
FIG. 2 is a sectional view of the ejector of FIG. 1 taken along the line 2—2.

FIGS. 1 to 4 are views showing the ejector. The ejector is intended to eject particles with which a sheet-like substrate, which is one form of a substrate, is coated. In the present embodiment, the coated substrate is an abrasive sheet. An ejector 100 as shown in FIGS. 1 and 2 comprises a storage container 110, an ejection gas nozzle 120, a discharge tube 130, an outer container 140, and a gas-pressure buffer portion 150.

The storage container 110, which has its container interior formed into a conical shape so that particles can be easily fed from a later-described particle feeder and ejected from the container, is to store the particles in a container interior 111. Also, the storage container 110 is made of a porous material so as to be capable of feeding gas from outside the container to inside the container via numerous pores. The wall thickness of the storage container 110 is determined by taking into consideration pressure loss due to the wall thickness as well as material strength, it is finally determined experimentally so that gas will be ejected uniformly from an inner wall surface 115 of the storage container 110.

The porous material preferably comprises specified-size pores irrespective of its type. The porous material may be selected from among, for example, ceramics such as SiC and $Al_2O_3$, plastics such as Teflon (trademark of Du Pont Co.), metallic materials of sintered stainless steel, and rubber materials, depending on the conditions under which it is used. As for the size of the pores formed in the porous material, too small a size would result in too large resistance in passage of the gas through the pores, making it difficult to control the gas pressure. Too large a size, conversely, would make it likely that the particles adhere to the inner wall surface 115 of the storage container 110 during or after the use of the ejector 100 and tend to clog the pores.

Accordingly, the optimum condition of the pore size is determined experimentally in connection with other factors, for example, gas ejection pressure or the shape of the storage container 110 and so on. In experiments, for example, with the gas ejection pressure of 0.01 MPa, with a particle size of 10 $\mu$m, it has been determined that the pore diameter of the porous material is preferably set to 20 $\mu$m to 100 $\mu$m such that the aforementioned problems are unlikely to occur in general cases The ejection gas nozzle 120 is a nozzle that acts to feed ejection gas into the storage container and eject the particles stored in the container interior 111 to outside of the storage container. The nozzle 120 is fitted from outside of the storage container 110 to a concave portion 112 formed at a bottom portion of the conical storage container 110.

The discharge tube 130, which is disposed at the concave portion 112 and coaxially with the ejection gas nozzle 120, is a nozzle that discharges both the ejection gas ejected from the ejection gas nozzle 120 and the particles stored in the storage container 110 to outside of the storage container 110.

The outer container 140 is a container that surrounds the storage container 110 with a proper clearance against an outer side face 113 of the storage container 110. The clearance forms a gas-pressure buffer portion 150. The gas-pressure buffer portion 150 optionally may be provided between a bottom face 114 of the storage container 110 and the outer container 140. The ejection gas nozzle 120 and the discharge tube 130 are arranged to penetrate through the outer frame container 140. The outer container 140 is preferably made of a metallic material with a view to ensuring the strength of the ejector 100, but may be any suitable strong material such as ceramics or the like.

The gas-pressure buffer portion 150 forms a space that is closed by an upper lid 141 being screwed to the outer container 140. As a result, pressure of the gas fed from an agitation gas inlet hole 142 opened at one or more points of the outer container 140 is applied generally uniformly to the entire outer wall of the storage container 110 without being applied directly to part of the storage container 110, so that a uniform gas ejection at the inner wall surface 115 of the storage container 110 is obtained. It is noted that although the gas-pressure buffer portion 150 is formed into chambers communicating with each other in the present embodiment, it optionally may be divided into discrete areas. In the case where the gas-pressure buffer portion 150 is divided into discrete areas, agitation gas inlet holes 142 are formed in the outer container 140 corresponding to the areas.

Figure 3:
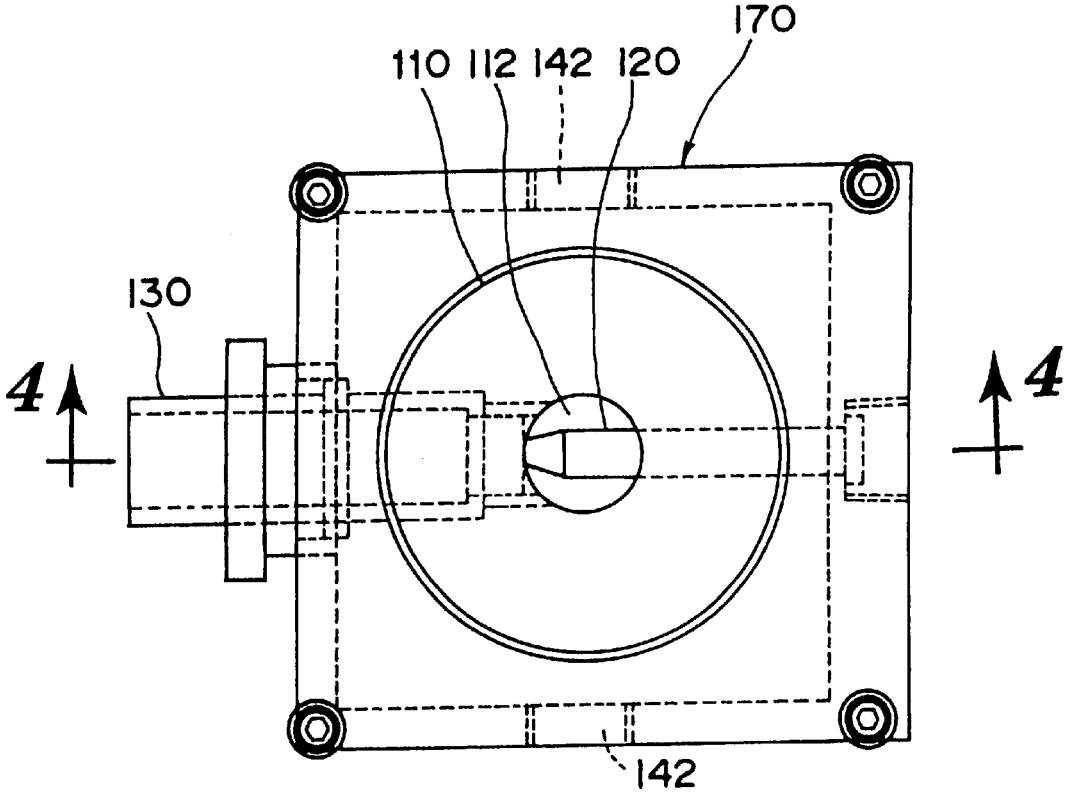
FIG. 3 is a plan view of a second embodiment of an ejector according to the present invention.
Figure 4:
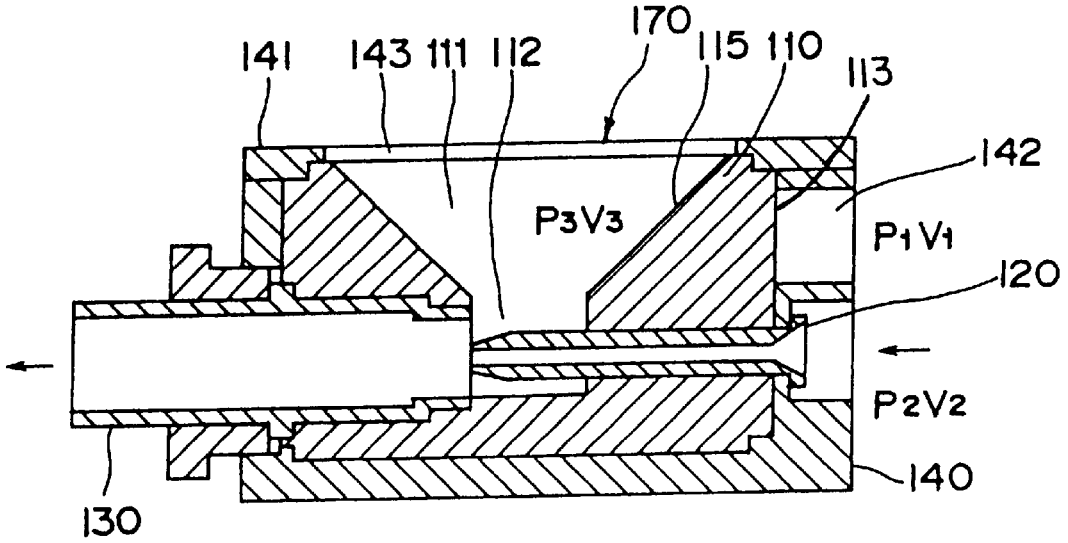
FIG. 4 is a sectional view of the ejector of FIG. 3 taken along the line 4—4.

The gas-pressure buffer portion 150 may be omitted as shown in an ejector 170 in FIGS. 3 and 4. In this embodiment, gas is fed directly from the agitation gas inlet holes 142 to the outer side face 113 of the storage container 110. The fed gas, passing through the pores of the storage container 110, is fed to the inside of the storage container. Further, without the gas-pressure buffer portion 150, it is preferable, in particular, to arrange a plurality of agitation gas inlet holes 142 so that the gas will be ejected through the conical inner wall 115 and concave portion 112 of the storage container 110.

The upper lid 141 is provided with an opening 143 so that particles can be fed to the container interior 111 of the storage container 110.

The gas to be fed to the ejection gas nozzle 120 and the agitation gas inlet holes 142 may comprise inert gases such as nitrogen, argon and the like, or air. Preferably the gas is controlled for humidity and temperature, and is preferably a gas containing a liquid having a surface tension of 40 dyne, for example, vapor of ethanol or perfluorocarbon.

Furthermore, although the storage container 110, the outer container 140, and the like are formed into a rectangular shape as shown in the figure in the present embodiment, they may comprise any others desired shape.

The use of the above-described ejector 100 is now described.

When agitation gas is fed to the agitation gas inlet holes 142, a generally uniform gas pressure is applied to the outer side face 113 of the storage container 110 via the gas-pressure buffer portion 150. The agitation gas, passing through the pores, is fed to the storage container interior 111, where it agitates the particles present at least in the concave portion 112 provided at the bottom portion of the storage container 110 where the ejection gas nozzle 120 and the discharge tube 130 are disposed. Further, the gas agitates the particles stored in the interior 111 of the storage container 110. Meanwhile, the particles agitated by the ejection gas are also ejected through the discharge tube 130 and ejected to outside of the ejector 100 together with the ejection gas.

Figure 5:
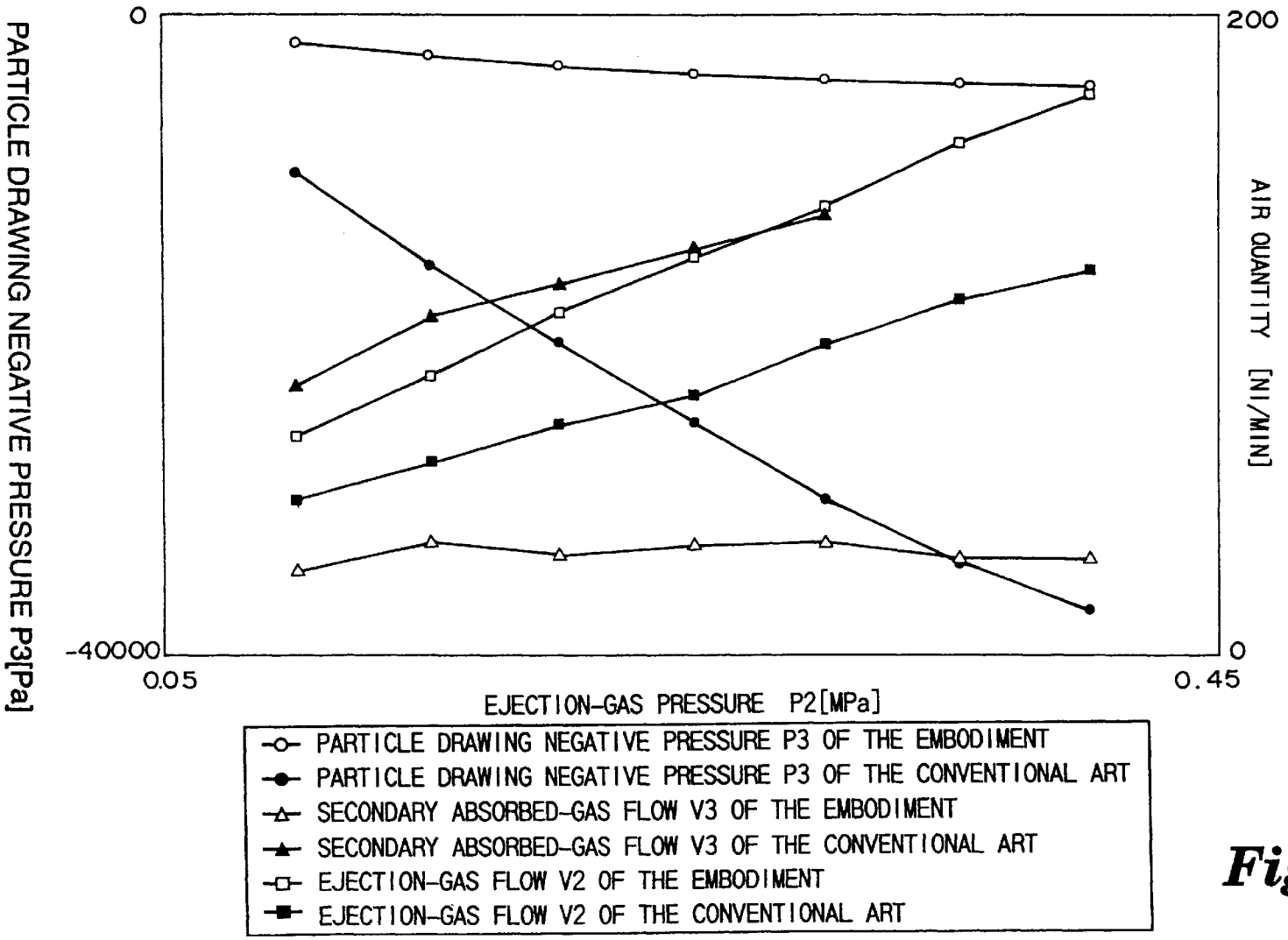
FIG. 5 is a graph showing results determined by experiments upon relationships among particle drawing negative pressure $P_3$, ejection gas flow $V_3$, and secondary absorbed gas flow $V_3$ with respect to ejection gas pressure $P_2$.
Figure 12:
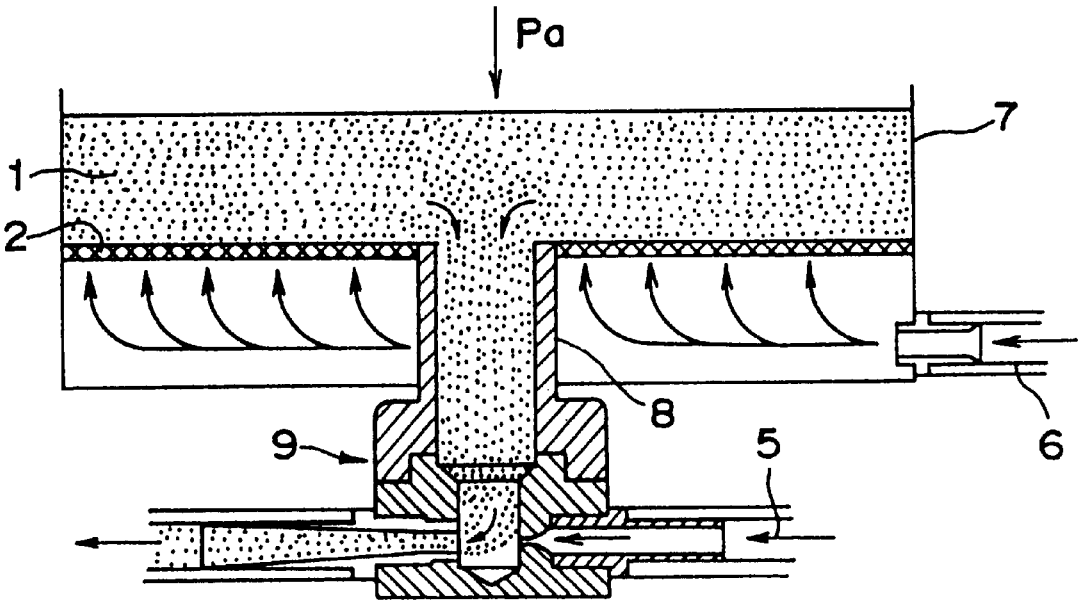
Fig. 12 PRIOR ART
FIG. 12 is a sectional view showing a conventional ejector.

In connection to the above operation, on the assumption that a pressure of the ejection gas fed to the ejection gas nozzle 120 is $P_2$, a flow of the ejection gas is $V_2$, a particle drawing negative pressure in the container interior 111 is $P_3$, and that a flow of secondary absorbed gas which is absorbed and discharged together with the particles in the storage container interior 111 is $V_3$, FIG. 5 shows an example of the experimental results of relationships among the particle drawing negative pressure $P_3$, the ejection gas flow $V_2$, the secondary absorbed gas flow $V_3$, with respect to the ejection gas pressure $P_2$. The unit for the values of the $V_2$ and $V_3$ is "N1/min" which means a gas flow (1) per one minute converted at standard condition (1 atm, 0° C.). The dimensions of the ejector used to generate the data presented in FIG. 5 are as follows. The storage container 110 has a square shape with its each side of approximately 56 mm and a height of approximately 38 mm. The container interior 111 has a conical shape with a maximum diameter of approximately 50 mm. The concave portion 112 has a diameter of approximately 15 mm and a depth of approximately 13 mm. A clearance corresponding to the gas-pressure buffer portion 150 is approximately 3 mm. In the figure, white or open marks denote results from the embodiment ejector, while black or closed marks denote results from the conventional ejector as illustrated in FIG. 12. FIG. 5 suggests the following:

1) The ejection gas pressure $P_2$ is related linearly to the spraying pressure of a coating means, for example, a corona charge type spray gun, and therefore should be set optionally depending on the environment under which particles are coated onto the substrate;

2) Meanwhile, in order to coat the substrate with the particles uniformly every time, it is preferable that the feed of particles from the particle feeder to the ejector is controlled so as to be carried out under constant conditions, and that the drawing conditions at the orifice of the ejector, particularly the particle drawing negative pressure $P_3$ and the secondary absorbed gas flow $V_3$, are maintained as constant conditions even if the ejection gas pressure $P_2$ has changed; and 3) As shown in FIG. 5, with the ejector of the present embodiment it is found that the particle drawing negative pressure $P_3$ and the secondary absorbed gas flow $V_3$ are held generally constant independently of the ejection gas pressure $P_2$, suggesting high performance as the function of an ejector. In contrast, with the conventional ejector it is found that the particle drawing negative pressure $P_3$ increases monotonically toward the negative pressure with increasing ejection gas pressure $P_2$, while the secondary absorbed gas volume $V_3$ increases also monotonically, with the result that the drawing conditions at the orifice undergo a great change.

Next described is an embodiment of the particle-coated substrate fabricating apparatus incorporating the above-described ejector 100 or ejector 170 of the present invention (hereinafter, typified by the ejector 100).

Figure 6:
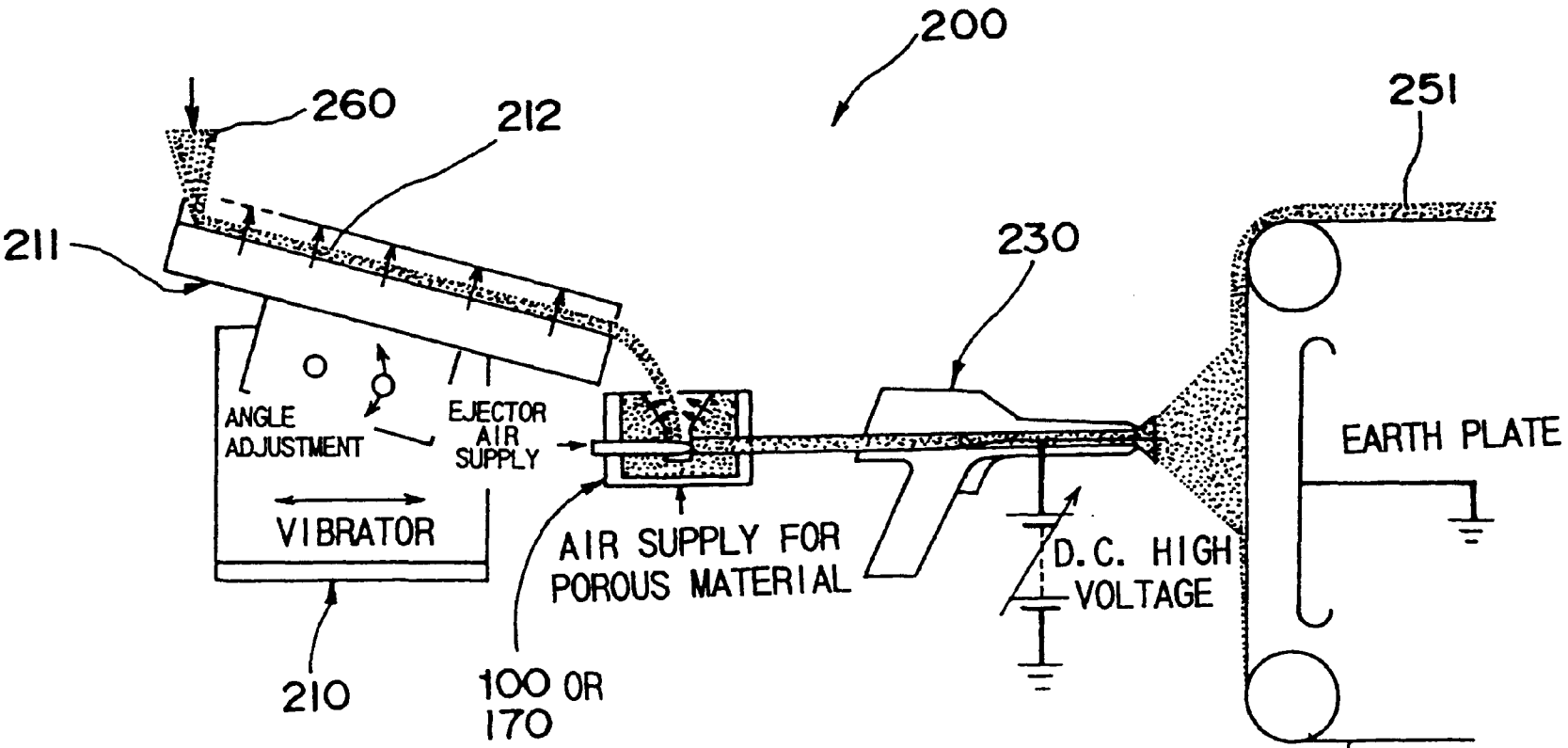
FIG. 6 is a view of an arrangement of a coated substrate fabricating apparatus according to the present invention.

As shown in FIG. 6, the fabricating apparatus 200 comprises the ejector 100 as described above, a particle feeder 210 provided upstream of the ejector 100 and serving for feeding particles to the storage container 110, and a coating device 230 provided downstream of the ejector 100 and serving for coating a sheet-shaped substrate 250 with the particles.

The particle feeder 210 has a vibrative air slider 211. The vibrative air slider 211 has a vibration floor 212 that serves to vibrate a floor surface to which the particles are fed, and to eject gas from the floor surface, so that the particles are dispersed and then fed to the ejector 100. In this way, the particle feeder 210 fluidizes fine particles measured and fed to the feed side of the vibration floor 212 by vibrating the vibration floor 212 and ejecting the gas.

In one preferred embodiment, the V-20B made by Shinko Electric Co., Ltd. is used as the vibration source of the vibrative air slider 211, and the vibration floor 212 is made of stainless steel having a 9 $\mu$m mesh. The pressure of the gas fed to the vibration floor 212 is 0.01 MPa.

Other embodiments of the particle feeder comprise reciprocative type feeders, rotating vertical spindle type feeders, rotating horizontal spindle type feeders, screw type feeders, endless belt type feeders, volumetric type feeders, and fluidized type feeders, or combinations of these feeders.

The coating device 230 is given by a corona charge type spray gun in the present embodiment. In one preferred embodiment, a corona charge type spray gun made by Ransburg Industry Co., Ltd., model number MPS1-F is used.

In one preferred embodiment, the material of the storage container 110 of the ejector 100 is Teflon (trademark of Du Pont Co.), and the agitation gas pressure is 0.01 MPa. Also, the ejection gas pressure $P_2$ is 0.3 MPa.

Other embodiments of the coating device include hybrid type spray guns and triboelectric charge type spray guns.

In addition, dispersing apparatus may be arranged by mechanically connecting the vibrative air slider 211 and the ejector 100 with each other, so that the ejector 100 is also vibrated by the variation of the vibrative air slider 211.

It may also be arranged that a particle transfer tube between the ejector 100 and the coating device 230 is vibrated.

The fabricating apparatus 200 having the above-described arrangement operates in the following manner. Fine particles 260 fed to the vibrative air slider 211 are fed to the storage container 110 of the ejector 100 while it is controlled so as not to undergo blocking, agglomeration, or the like due to variations of the vibrative air slider 211 and ejection of the gas. In the storage container 110 of the ejector 100, the particles are agitated and then ejected from the discharge tube 130 with ejection gas, and thus fed to the coating device 230. The coating device 230 applies the fed particles onto the sheet, which is the substrate 250, by an electrostatic coating method.

Figure 7:
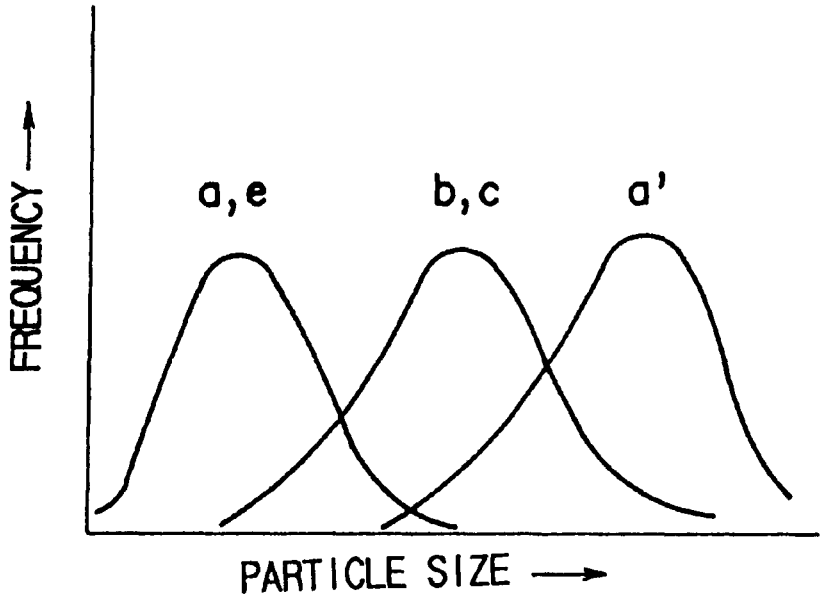
FIG. 7 is a graph showing variation in the particle size distribution of particles from when it is fed to the fabricating apparatus shown in FIG. 6 until when it is coated to the substrate.
Figure 8:
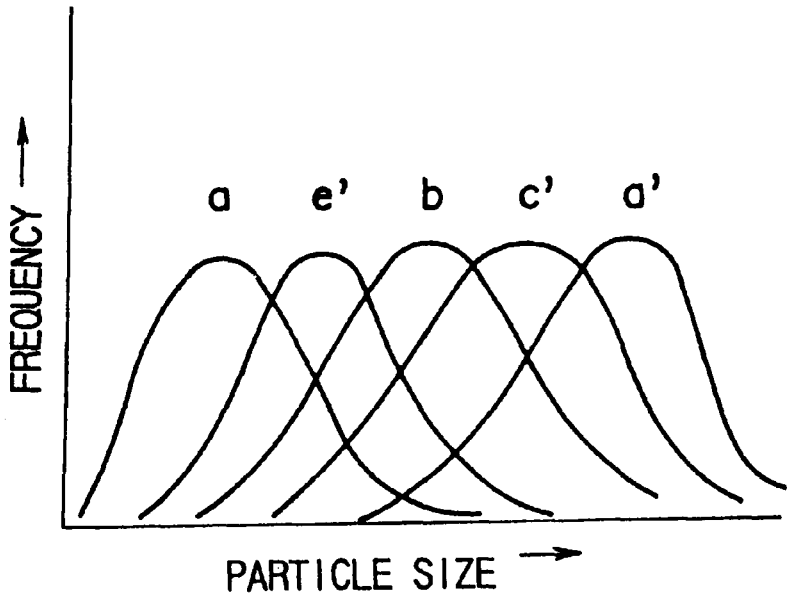
FIG. 8 is a graph showing variation in the particle size of particles from when they are fed to a conventional fabricating apparatus until when it is coated to the substrate, in the conventional coated substrate fabricating apparatus.

Referring to the above fabricating apparatus 200, the particle size distribution of the particles 260 in the process from when the particles are fed to the vibrative air slider 211 until coated to the substrate 250 is explained with reference to FIGS. 7 and 8, based on a comparison between a case where the ejector 100 of the present invention is used and another case where the conventional ejector as illustrated in FIG. 12 is used. It is noted that the particles to be coated to the substrate 250 comprise abrasive particles.

The abrasive particles to be coated to the substrate 250, after milling, is classified and then has a specified particle size distribution. Then, the particles are granulated and temporarily stored. The particles may tend to cohere while stored The particle size obtained over the process is assumed as "a'".

Meanwhile, in the state that the abrasive sheet 251 has been begun to be fabricated, the particles 260 are fed to the vibrative air slider 211 in a predetermined quantity, where it is fluidized by gas ejection and vibrations derived from the vibration floor 212 of the vibrative air slider 211 As a result, the cohered particles are re-divided into a coarse particle size of "b". Then with the particle size distribution of "b", the particles are fed to the storage container 110 of the ejector 100.

Within the storage container 110 of the ejector 100 of the present embodiment, as described above, the particles are agitated with agitation gas so as to be kept in a fluidized state, with its particle size distribution maintained in the fine particle state, without causing blocking or agglomeration which would occur in the conventional case. The particle size distribution obtained in this case is indicated by "c" as shown in FIG. 7.

In the conventional ejector, on the other hand, fed particles are deposited in the ejector and undergo blocking and agglomeration among particles which results in coarser particles. The resulting particle size distribution is indicated "c'" as shown in FIG. 8.

The particles in the ejector 100 of the present embodiment are subjected to a shear force when entering the high-speed gas stream of the agitation gas at the orifice of the ejector 100, such that it is crushed. Thus, its particle size distribution results in "e" as shown in FIG. 7. Accordingly, when the ejector 100 of the present embodiment is used, there will not occur blocking or agglomeration among particles within the ejector 100. As a result, the particle size distribution "e" of the coating particles becomes a fine and constant distribution, and one approximate to the particle size distribution "a" of the primary particle can be easily attained.

On the contrary, when the conventional ejector is used, blocking and agglomeration tends to occur in the ejector. Accordingly, as shown in FIG. 8, the particle size distribution "e'" of the coating particles would be one inferior to the particle size distribution "a" of the primary particles.

As seen above, with the use of the ejector 100 of the present invention, the particles remain in a fluidized state within the ejector container Accordingly, blocking, agglomeration or the like is unlikely to occur, making it easy to maintain fine particle size distribution. Also, drawing of the particles at the orifice of the ejector can be made constant irrespectively of the particle drawing negative pressure $P_3$, allowing uniform coating of the particles to be achieved.

Using the above-described fabricating apparatus 200 allows the abrasive sheet to be fabricated under processes of various conditions. One preferred embodiment of the particle-coated substrate fabricating method is shown below.

Abrasive kraft paper is used as the substrate 250.

The adhesive comprises the following components:

| | | |
|---|---|---|
| Epoxy resin | 100 | parts by weight |
| Curing agent | 3.0 | parts by weight |
| Xylene | 34.3 | parts by weight |
| | 137.3 | parts by weight |

First, the above adhesive is coated onto the substrate 250 at 22° C., 110 g/m2.

Particle coating is performed on the adhesive coated to the substrate 250 under the following conditions.

Aluminum oxide #4000 is used as the particles. The table type feeder (made by Funken Powtechs, Inc., 25 g/min feed)

is used as the feeder to the vibrative air slider 211. With the use of the vibrative air slider 211, the ejector 100, and the coating device 230, the particle spray coating is performed on the substrate 250. The particle spray coating method is performed in two ways, one with electric field applied and the other not.

The layer subjected to the particle spray coating is dried in a ventilated furnace at 140° C. for 5 min. Then, the same adhesive is further coated onto the dried layer under the same conditions and dried under the same conditions.

Next, a coated substrate (hereinafter, referred to also as "abrasive paper"), which is one form of the coated substrate fabricated by the fabricating method with the use of the above-described fabricating apparatus 200, is described with a comparison to a coated sheet fabricated by the conventional fabricating apparatus.

When a sheet is fabricated by using the conventional ejector, in which a contact surface at which particles are brought into contact with the ejector is not formed of a porous material, particles composed of less cohesive particles, i.e., larger particles can be coated by using the conventional ejector whereas particles composed of smaller particle size (e.g., 5 μm or less), adhere to and are deposited onto the contact surface of the conventional ejector by their cohesion. The particles deposited in this way, when reaching to some degree of amount, will be absorbed into a gas stream of the ejection gas fed to the conventional ejector by the action of gravity or the like, and dispersed by the shearing action of the ejection gas. However, the particles drawn into the ejector in cohered state are not dispersed sufficiently, and the cohered particle is drawn into the gas stream irregularly. As a result, the particles in the gas ejected from the conventional ejector cannot be maintained at a constant concentration within the spray stream.

As seen above, when the conventional ejector is used, cohered particles are present on the surface of the sheet and the concentration of particles ejected from the ejector is not uniform. Thus, products obtained in this case would include variations in the coating thickness of the particles.

On the contrary, when the above-described ejector of the present invention is used, such problems described above do not occur. Therefore, products of various abrasive particle sizes can be fabricated over the range of from coarse to fine particles without any difficulties.

Table 1 shows results of comparison between a case where the ejector of the present invention is used and another case where the conventional ejector is used, with respect to a rate of non-defective products for abrasive papers of various abrasive particle sizes. It is noted that particles are coated onto the sheets by the electrostatic coating method. In a column for the ejector of the present invention in Table 1, "A" denotes the embodiment of the ejector 170 in which the gas-pressure buffer portion 150 is not provided but a plurality of agitation gas inlet holes 142 are provided, while "B" and "C" denote embodiments of the ejector 100 in which the gas-pressure buffer portion 150 is provided. Further, in the cases of "A" and "B", the coating process involves the action of electric field; and in the case of "C", an electric field was not used.

TABLE 1

| Type of abrasive sheet | | Rate of non-defective products with the use of the embodiment ejector | | | Rate of non-defective |
|---|---|---|---|---|---|
| Abrasive particle size (μm) | Item (#) | A (%) | B (%) | C (%) | products conventional method |
| 15 | 1000 | 100 | 100 | 100 | 100 |
| 9 | 2000 | 100 | 100 | 100 | 85 |
| 5 | 3000 | 100 | 100 | 100 | 0 |
| 3 | 4000 | 98 | 98 | 97 | 0 |
| | | | | | Cannot be fabricated |
| 1 | 8000 | 96 | 95 | 80 | 0 |
| | | | | | Cannot be fabricated |
| 0.5 | — | 90 | 93 | 70 | 0 |
| | | | | | Cannot be fabricated |
| 0.1 | — | 53 | 54 | 51 | 0 |

Table 2 shows results of comparison between an abrasive efficiency of the abrasive paper fabricated by the conventional method (slurry method) in which abrasive particles are previously mixed with an adhesive and coated onto the substrate, and another abrasive efficiency of the abrasive paper fabricated by using the ejector of the present invention. It is noted that the abrasive paper fabricated by using the ejector of the present invention is applied by the electrostatic coating method, and that an ejector with the gas-pressure buffer portion 150 provided is used. Further, the abrasive efficiency refers to one which shows a change in weight between before and after the abrasion of 4×6 inch square samples when the samples are rubbed 1000 times of reciprocation, the abrasive efficiency showing that the larger a value of the abrasive efficiency is, the more successfully abrasion can be achieved. In Table 2, the abrasive paper as shown in FIG. 9 is used in a methods numbered "1" to "4" of this embodiment whereas the abrasive paper as shown in FIG. 10 is used in the methods numbered "5" and "6" of this embodiment.

TABLE 2

| | | Base | | | Abrasive Particles | | Abrasive Efficiency | | | |
|---|---|---|---|---|---|---|---|---|---|---|
| | Fabricating | | Thickness | | | Particle | Acryl plate | Copper plate | Remarks | |
| | Method | Material | (mil) | Binder | Material | size (μm) | (g) | (g) | Electric field | |
| 1 | Embodiment | PET | 3 | Polyester | $Al_2O_3$ | 3 | 0.35 | 0.45 | Present | Gas-pressure |
| 2 | Embodiment | PET | 3 | Epoxy | $Al_2O_3$ | 3 | 0.32 | 0.48 | Present | buffer portion provided |
| 3 | Embodiment | PET | 3 | Polyester | $Al_2O_3$ | 3 | 0.30 | 0.42 | Absent | Gas-pressure |
| 4 | Embodiment | PET | 3 | Epoxy | $Al_2O_3$ | 3 | 0.31 | 0.43 | Absent | buffer portion provided |
| 5 | Embodiment | PET | 3 | Polester | $Al_2O_3$ | 3 | 0.25 | 0.26 | Present | Gas-pressure |
| 6 | Embodiment | PET | 3 | Epoxy | $Al_2O_3$ | 3 | 0.28 | 0.23 | Present | buffer portion provided |
| 7 | Conventional | PET | 3 | Polyester | $Al_2O_3$ | 3 | 0.09 | 0.11 | — | — |
| 8 | Conventional | PET | 3 | Epoxy | $Al_2O_3$ | 3 | 0.08 | 0.07 | — | — |

Figure 9:
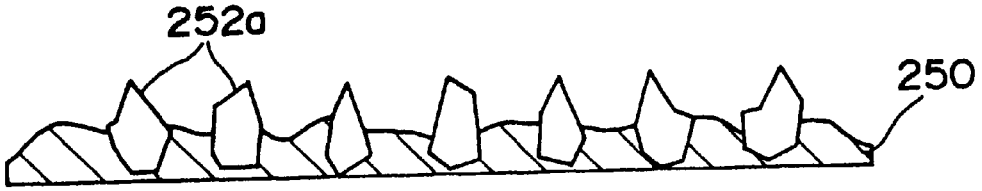
FIG. 9 is a view showing a state of the particles in the coated substrate fabricated by the fabricating apparatus shown in FIG. 6.
Figure 10:
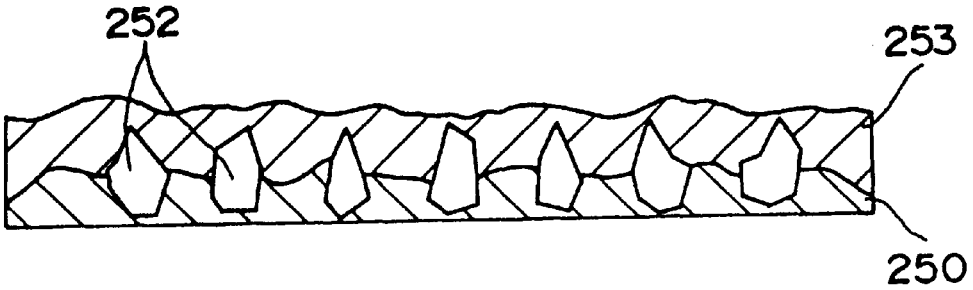
FIG. 10 is a view showing another state of the particles in the coated substrate fabricated by the fabricating apparatus shown in FIG. 6.
Figure 11:
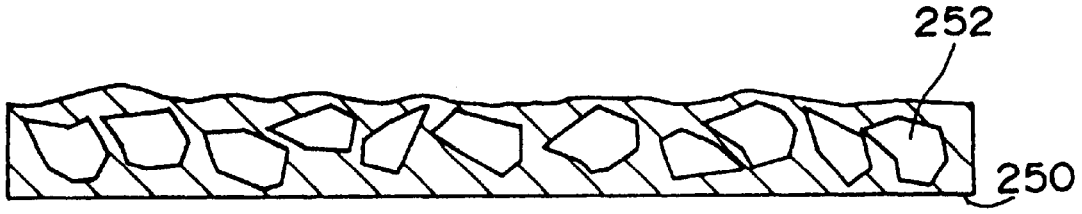
FIG. 11 is a view showing a state of particles in the coated substrate fabricated by a conventional fabricating apparatus.

As will be understood from the comparison between FIG. 9, which shows the abrasive paper in the cases of the present embodiment, and FIG. 11, which shows an abrasive paper in the case of the conventional abrasive paper, the reason that the abrasive efficiency of the abrasive paper according to the present embodiment is better than that by the conventional method is due to the form of abrasive particles 252 on the substrate 250. In other words, in the conventional method, because of strong cohesion of the particles ejected from an ejector, the particles cannot be coated in a dry state. So, a mixture of the particles with an adhesive is coated onto the substrate by using a spatula or the like. Accordingly, as shown in FIG. 11, edge portions 252*a* of the abrasive particles 252 are not generally perpendicular to the substrate but result in a lateral arrangement generally parallel to the substrate.

In contrast to this, in the present invention, the particles in the ejector can be made less cohesive so that only the abrasive particles 252 are coated to the substrate 250. In other words, there can be fabricated an abrasive paper in which the abrasive particles are coated onto the adhesive on the surface of the substrate 250 as shown in FIG. 9, and moreover another abrasive paper in which a second adhesive 253 is coated onto the particles as shown in FIG. 10. Accordingly, in the abrasive paper according to the present invention, the edges 252*a* of the abrasive particles 252 are arranged irregularly with respect to the substrate 250, so that the surface of the abrasive paper is not formed into a flat plane unlike the conventional method. This accounts for a significant difference in abrasive efficiency as much as approximately three times that of the conventional method. Yet, as shown in Table 2, some differences of the abrasive efficiency are recognized among the embodiments, due to the orientation of the abrasive particles 252 onto the substrate 250 (when the electrostatic coating is used, the major axes of the abrasive particles are more likely to be arranged as they are aligned along a direction of the electric field), as well as due to a degree of coating of the adhesive. However, the differences are small as compared with the conventional examples, such that the advantages of the present invention can be remarkable in each case. In addition, the reason why even the abrasive paper shown in FIG. 10 is superior in abrasive efficiency to the conventional examples is that the adhesive 253, even if it has covered an entire surface of the abrasive particles 252, will be compressed during abrasion, causing the abrasive particles 252 to act upon an abraded object. A further reason is that, in the abrasive sheet of the present invention the edges 252*a* of the abrasive particles 252 are oriented toward an abraded surface of the abraded object, as compared with the conventional examples.

When a particle made of $Al_2O_3$ with a particle size of 3 $\mu$m is coated onto an unwoven fabric made of nylon resin, the abrasive fabric in the case of the present invention has the substrate 250 coated with the particles more finely and more uniformly than in the conventional examples.

As described above, according to the ejector of the present invention, the agitation gas, passing through the storage container, is fed to the particles present at least at the bottom portion of the storage container where the ejection gas nozzle and the discharge tube are disposed. Thus, the particles are agitated in the storage container in order not to cause blocking, agglomeration, or bridging, making it possible to obtain a uniform particle size distribution of the particles ejected from the ejector.

Also, according to the fabricating apparatus of the present invention, in the ejector to which particles are fed from the particle feeder, the agitation gas, passing through in the storage container, is fed to the particles present at least at the bottom portion of the storage container where the ejection gas nozzle and the discharge tube are disposed. Thus, the particles are agitated in the storage container in order not to cause blocking, agglomeration or bridging, making it possible to obtain a uniform particle size distribution of the particles ejected from the ejector.

Further, according to the fabricating method of the present invention, in the particle agitating process, the agitation gas is fed to the particles present at least at the bottom portion of the storage container where the ejection gas nozzle and the discharge tube are disposed, via the inner wall of the storage container comprised to the ejector. Thus, the particles in the storage container are agitated in order not to cause blocking, agglomeration or bridging, making it possible to obtain a uniform particle size distribution of the particles ejected from the ejector.

Furthermore, by the arrangement that the agitation gas is fed to the particles present at least at the bottom portion of the storage container where the ejection gas nozzle and the discharge tube are disposed, via the inner wall of the storage container comprised to the ejector, the particles in the storage container are agitated in order not to cause blocking, agglomeration or bridging, making it possible to obtain a uniform particle size distribution of the particles ejected from the ejector. Therefore, the coated substrate of the present invention can be made into a particle-coated substrate in which particles are coated onto the substrate with a uniform particle size distribution.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

We claim:

1. An ejector for ejecting particles to be coated onto a substrate, comprising:

a storage container made of a porous material, the container including an interior adapted for storing particles in the container and an outer surface;

an ejection as nozzle extending from outside the container to the interior and provided at a bottom portion of the storage container, in a portion thereof where the particles are stored, adapted for feeding to the interior of the storage container an ejection gas to be ejected to outside of the storage container;

a discharge tube arranged generally coaxially of the ejection gas nozzle at the bottom portion of the storage container and extending from the interior of the container to outside the container, and adapted for sending the ejection gas and the particles from the interior to outside of the storage container;

an agitation gas inlet in fluid communication with the outer surface of the porous storage container adapted for feeding an agitation gas from the outside of the storage container through the porous container to the interior of the storage container to perform agitation for imparting a fluidized state to the particles present at least at the bottom portion of the storage container interior where the ejection gas nozzle and the discharge tube are disposed; and an outer container forming a gas-pressure buffer portion defined by a clearance between the outer container and the outer surface of the storage container where the ejection gas nozzle and the discharge tube are disposed, wherein the agitation as inlet is in fluid communication with the buffer portion and wherein the gas-pressure buffer portion is formed so as to surround the storage container.

2. An apparatus including an ejector as claimed in claim 1 for fabricating a particle-coated substrate, the apparatus comprising:

an ejector as claimed in claim 1;

a particle feeder for providing particles to the interior of the ejector storage container; and a coating device arranged in fluid communication with the discharge tube of the ejector for coating a substrate with the particles sent out from the ejector by means of the ejection gas.

3. A method for fabricating a particle-coated substrate, comprising the steps of:

(a) feeding particles to a storage container of an ejector, the ejector comprising:

(i) a storage container made of a porous material, the container including an interior adapted for storing particles in the container and an outer surface; and (ii) an outer container forming a gas-pressure buffer portion defined by a clearance between the outer container and the outer surface of the storage container, wherein the gas-pressure buffer portion is formed so as to surround the storage container;

(b) agitating the particles with an agitation gas provided through an agitation gas inlet in fluid communication with buffer portion and the outer surface of the porous container, though the buffer portion, and through the porous container to the interior of the storage container to perform agitation for imparting a fluidized state on the particles present at least at the bottom portion of the storage container;

(c) ejecting the fluidized particles from the interior of the container by providing an ejection gas through an ejection gas nozzle extending from outside the container to the interior and provided at a bottom portion of the container where the particles are fluidized, the ejection gas and particles exiting the storage container through a discharge tube arranged generally coaxially of the ejection gas nozzle; and (d) coating a substrate with a coating device with the particles sent out from the discharge tube by means of the ejection gas.

* * * * *

UNITED STATES PATENT AND TRADEMARK OFFICE

CERTIFICATE OF CORRECTION

PATENT NO. : 6,040,004
DATED : March 21, 2000
INVENTOR(S) : Kenji Matsumoto, Kazuo Suzuki, and Muneo Haga It is certified that error appears in the above-identified patent and that said Letters Patent is hereby corrected as shown below:

Column 9,
Under "Table 2," under section "Binder," line 5, "Polester" should read -- Polyester --

Column 14,
Line 7, "though" should read -- through --.

Signed and Sealed this

Twelfth Day of February, 2002

*Attest:*

*Attesting Officer*

JAMES E. ROGAN
*Director of the United States Patent and Trademark Office*